US008328656B2

(12) United States Patent
Rice et al.

(10) Patent No.: US 8,328,656 B2
(45) **Date of Patent: *Dec. 11, 2012**

(54) GOLF CLUB SHAFT WITH HIGH BALANCE POINT AND GOLF CLUB INCLUDING SAME

(75) Inventors: Scott A. Rice, Carlsbad, CA (US); Donald S. Bone, Carlsbad, CA (US); Dustin A. Barksdale, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/305,057

(22) Filed: Nov. 28, 2011

(65) Prior Publication Data

US 2012/0071266 A1 Mar. 22, 2012

Related U.S. Application Data

(62) Division of application No. 12/189,825, filed on Aug. 12, 2008, now Pat. No. 8,066,583.

(51) Int. Cl.
*A63B 53/10* (2006.01)
*A63B 53/12* (2006.01)

(52) U.S. Cl. ..... 473/292; 473/316

(58) Field of Classification Search ..... 473/316–323, 473/292, 282
See application file for complete search history.

(56) References Cited

U.S. PATENT DOCUMENTS

| | | | | |
|---|---|---|---|---|
| 3,679,207 | A | 7/1972 | Florian | |
| 5,093,162 | A | 3/1992 | Fenton et al. | |
| 5,308,062 | A | 5/1994 | Hogan | |
| 5,417,108 | A | 5/1995 | Chastonay | |
| 5,573,468 | A | 11/1996 | Baumann | |
| 6,328,660 | B1 | 12/2001 | Bunn | |
| 6,532,818 | B2 | 3/2003 | Blankenship | |
| 6,546,802 | B2 | 4/2003 | Shiraishi et al. | |
| 6,824,636 | B2 | 11/2004 | Nelson et al. | |
| 6,981,922 | B2 * | 1/2006 | Lenhof et al. | 473/305 |
| 7,338,386 | B2 | 3/2008 | Nakajima | |
| 2003/0083143 | A1 | 5/2003 | Kumamoto | |
| 2003/0207720 | A1 | 11/2003 | Sery | |

FOREIGN PATENT DOCUMENTS

| | | |
|---|---|---|
| JP | 11192330 | 7/1999 |

* cited by examiner

*Primary Examiner* — Stephen L. Blau
(74) *Attorney, Agent, or Firm* — Michael J. Mancuso

(57) ABSTRACT

A golf club shaft having a weight distribution such that the balance point percentage is less than or equal to 44.50%. The weight distribution of the shaft allows for an increase in length and/or club head weight of a golf club while having a reduced impact on the swing weight.

9 Claims, 4 Drawing Sheets

GOLF CLUB SHAFT WITH HIGH BALANCE POINT AND GOLF CLUB INCLUDING SAME

CROSS-REFERENCE TO RELATED APPLICATIONS

This application is a divisional of U.S. patent application Ser. No. 12/189,825, filed Aug. 12, 2008, now U.S. Pat. No. 8,066,583 which is incorporated herein by reference in its entirety.

FIELD OF THE INVENTION

This invention generally relates to golf club shafts, and more specifically to golf club shafts having high balance points.

BACKGROUND OF THE INVENTION

Oftentimes, to improve the performance of golf clubs the mass characteristics of a golf club head are altered to improve forgiveness and/or the length of the club is altered to increase head speed. However, the increased head weight and/or length in combination with conventional golf club shafts and grips often creates an undesirable feel during a swing of the golf club.

Golf club manufacturers have created the swing weight measurement to quantify the feel of rotating a golf club about a pivot point that is produced during a swing. Each of the components of a golf club has a mass and center of gravity location that is specific to its design and construction. The mass and location of the center of gravity of each component results in a net moment that can be calculated for any location along the club. Traditionally, swing weight has been quantified by determining the net moment applied by the components on a reference point designated at a location 14.0 inches from the butt end of the golf club.

The lengths of golf clubs through a set generally increase from the wedge-type clubs to wood-type clubs, which generally have lengths of 34.0-48.0 inches. Because of the lengths of the wood-type clubs and the location of the swing weight reference point, small changes in the weight of a club head and the length of the club have a dramatic impact on the swing weight of the assembled golf club.

Some manufacturers have done nothing to counter the effect of the increased length and/or heavier club heads and simply offer golf clubs having greater swing weight. As a result, the user is provided with a club that feels heavier through the swing, which is undesired by many players.

Others have made attempts to reduce the swing weight by adding weights at the grip end of the club and/or heavier grips to counteract the increased moment created by longer clubs and/or heavier club heads. For example, U.S. Pat. No. 4,690,407 to Reisner describes a weighted golf grip that includes a weight element fixed within the grip. The weighted grip is intended to weight the club behind the hands of the user to provide better control and tempo.

However, because the distance between the club head and the reference point is significantly greater than the distance between the reference point and the butt end of the golf club, any additional mass added on the club head end of the golf club must be counteracted by a much larger mass on the butt end of the golf club. As a result, a significant amount of weight must be added as a counterweight to balance even a small increase at the club head end and those weights add a significant amount of weight to the overall golf club weight. The increased overall weight also increases the difficulty in swinging the golf club.

Little attention has been given to the distribution of the existing weight in a golf club, especially the distribution of the weight of the shaft, which may also be used to alter the swing weight. Therefore, it is desirable to provide a golf club shaft that has a weight distribution that counteracts an increase in the swing weight of a golf club caused by an increase in length and/or club head weight.

SUMMARY OF THE INVENTION

The invention is directed to a golf club shaft having a high balance point and a golf club incorporating the shaft. Several embodiments of the present invention are described below.

In an embodiment, a shaft for a golf club includes an elongate body. The elongate body has a length greater than 42 inches and it extends between a tip end and a butt end. The center of gravity of the elongate body is located a distance from the butt end that is less than or equal to 44.50% of the length of the elongate body.

In another embodiment, a golf club includes a club head and a shaft. The club head has a mass greater than 180.0 grams. The shaft includes an elongate body that has a length greater than 44 inches and it extends between a tip end and a butt end. The center of gravity of the elongate body is located a distance from the butt end that is less than or equal to 43.75% of the length of the elongate body.

In a further embodiment, a golf club includes a shaft, a club head and a grip. The shaft includes an elongate body that has a length greater than 44 inches and it extends between a tip end and a butt end. The center of gravity of the elongate body is located a distance from the butt end that is less than or equal to 43.75% of the length of the elongate body. The club head is coupled to the tip end of the elongate body. The grip is coupled to the butt end of the elongate body. The club head and the shaft apply a net moment about a reference point located 14.0 inches from the butt end of the elongate body of 221.7-252.3 in-oz.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

The present invention is directed to a golf club shaft having a high balance point and a golf club incorporating the shaft. The high balance point of the shaft provides a golf club that allows a swing weight to be maintained while increasing the length of the club and/or the weight of the club head. As a result, the feel during the swing of the club is maintained while the club head speed is increased and/or the head mass properties are tailored to provide desired forgiveness.

Figure 1:
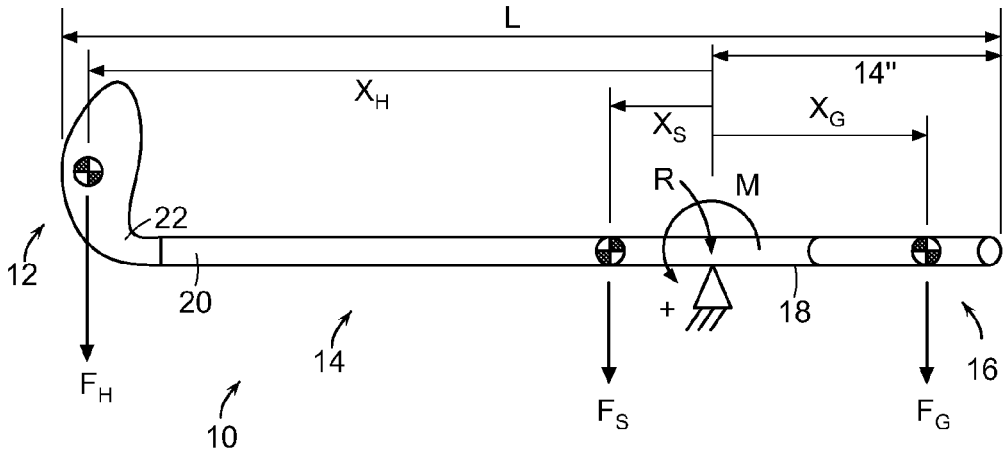
FIG. 1 is a schematic view of a golf club.

Referring to FIG. 1, the major components of golf club 10 include a club head 12, a shaft 14 and a grip 16. Shaft 14 is a generally elongate cylindrical member constructed from metal and/or carbon fiber composite materials. Shaft 14 includes a butt 18 and a tip 20. Head 12 includes a hosel 22 that receives and is attached to a portion of tip 20 such as by an adhesive. Hosel 22 may have a blind or through-bore construction. The length of shaft 14 is selected based on the desired length of golf club 10 and the configuration of hosel 22. For example, with a hosel having a blind configuration, shaft 14 has a length that is less than the length of the golf club by 1.0-2.0 inches, while a golf club having a through-bore hosel will include a shaft that is approximately the same as the overall club length.

Grip 16 is a generally tubular, cylindrical member that is coupled to butt 18 of shaft 14 and provides a surface that is easily gripped by a user so that the user is able to control the movement of golf club 10 during a swing. Generally, grip 16 is comprised of an elastic material and is attached to butt 18 using an adhesive tape. The grip generally has a weight of 35.0-75.0 grams, a length of approximately 10.5 inches, and a center of gravity located 2.0-8.5 inches from the butt end of grip 16.

As described above, one method of determining the swing weight of golf club 10 is to determine the net moment created by the components about reference point R that is located 14.0 inches from butt 18 of golf club 10. For example, the weight of club head 12 ($F_H$) is multiplied by the distance between the center of gravity of club head 12 and reference point R ($X_H$) to determine the moment caused by club head 12 about reference point R. Similarly, the weight of shaft 14 ($F_S$) is multiplied by the distance between the center of gravity of shaft 14 (also referred to as the "balance point") and reference point R ($X_S$) to determine the moment caused by shaft 14 about reference point R. Finally, the weight of grip 16 ($F_G$) is multiplied by the distance between the center of gravity of grip 16 and reference point R ($X_G$).

As depicted in FIG. 1 and in the present example, moments that cause golf club 10 to rotate about reference point R in a counterclockwise direction are given a positive value, while those tending to rotate golf club 10 about reference point R in a clockwise direction are given a negative value. Additionally and as depicted, the moments created by club head 12 and shaft 14 have a positive value and the moment created by grip 16 has a negative value. It should be appreciated that for the purposes of this discussion, the weight of any additional components, such as a ferrule and tape under grip 16, is so small that it has negligible effect on the swing weight of golf club 10.

As described above, the swing weight of golf club 10 is affected by the weight of each component as well as the distance between the center of gravity of the respective component and reference point R. For example, keeping all other attributes constant, as the length of golf club 10 is increased, distance $X_H$ and $X_S$ increase, resulting in an increased swing weight of golf club 10. Similarly, as the weight $F_H$ of club head 12 is increased, the swing weight of golf club 10 is increased. As a result, increasing the length of golf club 10 to increase head speed and ball travel distance and/or increasing the mass of club head 12 to provide more discretionary mass and more forgiving mass properties both tend to increase the swing weight of golf club 10.

Shaft 14 of the present invention provides a balance point that is shifted toward butt 18 of golf club 10, as compared to conventional shafts, to at least partially counter the effect of increasing the length and/or head weight of golf club 10. In particular, the shaft of the present invention has a length that is greater than or equal to 42.0 inches, and more preferably 44.0 inches, and a balance point percentage (BP%) that is less than or equal to 44.50% (i.e., the distance from the butt end of the shaft to the balance point is less than or equal to 44.50% of the shaft length $L_S$), and more preferably 43.75%, and a shaft weight less than 90.0 grams. As a result, the distance $X_S$ is reduced, thereby reducing the moment applied to reference point R by shaft 14, as compared to a conventional shaft of the same weight.

Figure 2:
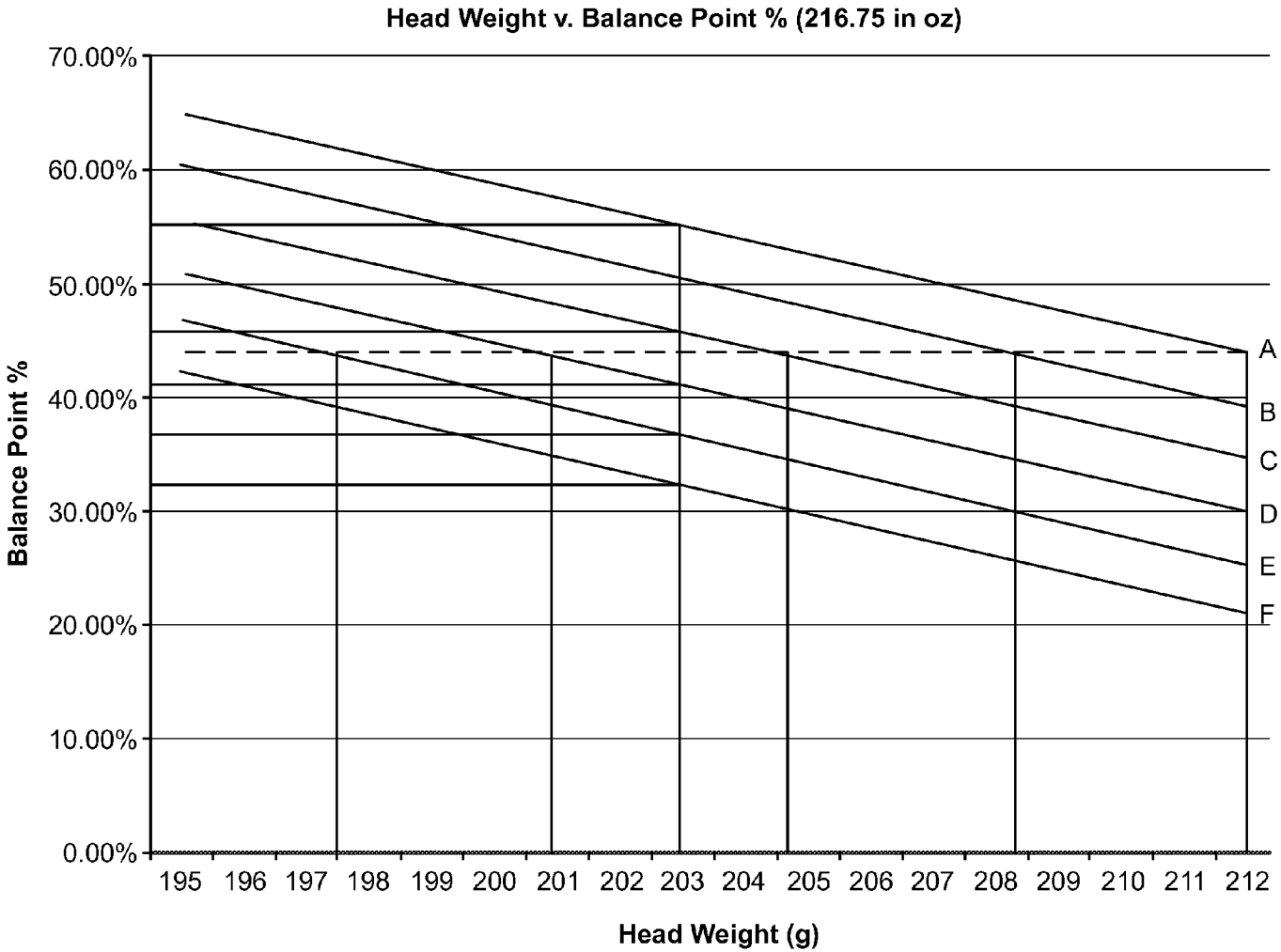
FIG. 2 is a graph illustrating the relationship between shaft balance point, club head weight and golf club length for a first swing weight.

The position of the balance point of shaft 14 allows more discretion in the length of golf club 10 and weight of club head 12 by reducing the impact of shaft 14 on the swing weight of golf club 10. Referring to FIG. 2, the relationship between balance point percentage and head weight is provided for golf clubs having various lengths and a swing weight of 216.75 in·oz, which corresponds to a swing weight of approximately D2 on the Lorythmic scale. The relationships shown in FIG. 2 are based on embodiments of golf club 10 including shaft 14 with a weight of 57.0 grams, grip 16 having a weight of 50.0 grams and a center of gravity located approximately 4.2 inches from the butt end, and club head 12 including a blind bore configured so that the length of shaft 14 is less than the overall club length by approximately 1.25 inches.

Each of isobars A-F illustrates the relationship between head weight and balance point percentage for golf club 10 having a particular length and a swing weight of 216.75 in·oz. For example, isobar A corresponds to golf club 10 having an overall length of 44.0 inches and illustrates that the swing weight is achieved with a shaft having a balance point percentage greater than 43.75% (as indicated by the dashed line) with a head weight less than approximately 212.0 grams. Isobar B corresponds to golf club 10 having an overall length of 44.5 inches and illustrates that the swing weight is achieved with a shaft balance point percentage greater than 43.75% with a head weight less than approximately 208.0 grams, but keeping all else equal including a head weight greater than 208.0 grams requires a shaft balance point percentage less than or equal to 43.75%. Isobar C illustrates the relationship for golf club 10 having an overall length of 45.0 inches and illustrates that the swing weight is achieved keeping the weight of the shaft and grip constant after increasing the weight of club head 12 above approximately 204.5 grams by reducing the shaft balance point percentage to less than or equal to 43.75%. Isobar D illustrates that the swing weight is achieved in a golf club having overall length of 45.5 inches and club head weight of approximately 201.0 grams with a shaft balance point percentage less than or equal to 43.75%. Isobar E corresponds to golf club 10 having an overall length of 46.0 inches and illustrates that the desired swing weight may be achieved by constructing the shaft so that has a balance point percentage less than or equal to 43.75% for club head 12 having a weight greater than approximately 197.5 grams. Isobar F illustrates the relationship for golf club 10 having an overall length of 46.5 inches and illustrates that for a club head having a weight greater than 195.0 grams the swing weight may be achieved by constructing shaft 14 to have a balance point percentage less than 43.75%.

Additionally, each of isobars A-F illustrates that reducing the balance point percentage of the shaft allows the length of golf club 10 to be increased for a club head having a constant weight. For example, for a club head weight of 203.0 grams, a swing weight of 216.75 in·oz is achieved in a 45.0 inch golf club with a balance point percentage of approximately 47.50%, but by reducing the balance point percentage to approximately 41.00% the same swing weight is achieved in a golf club having a length of 45.5 inches.

Figure 3:
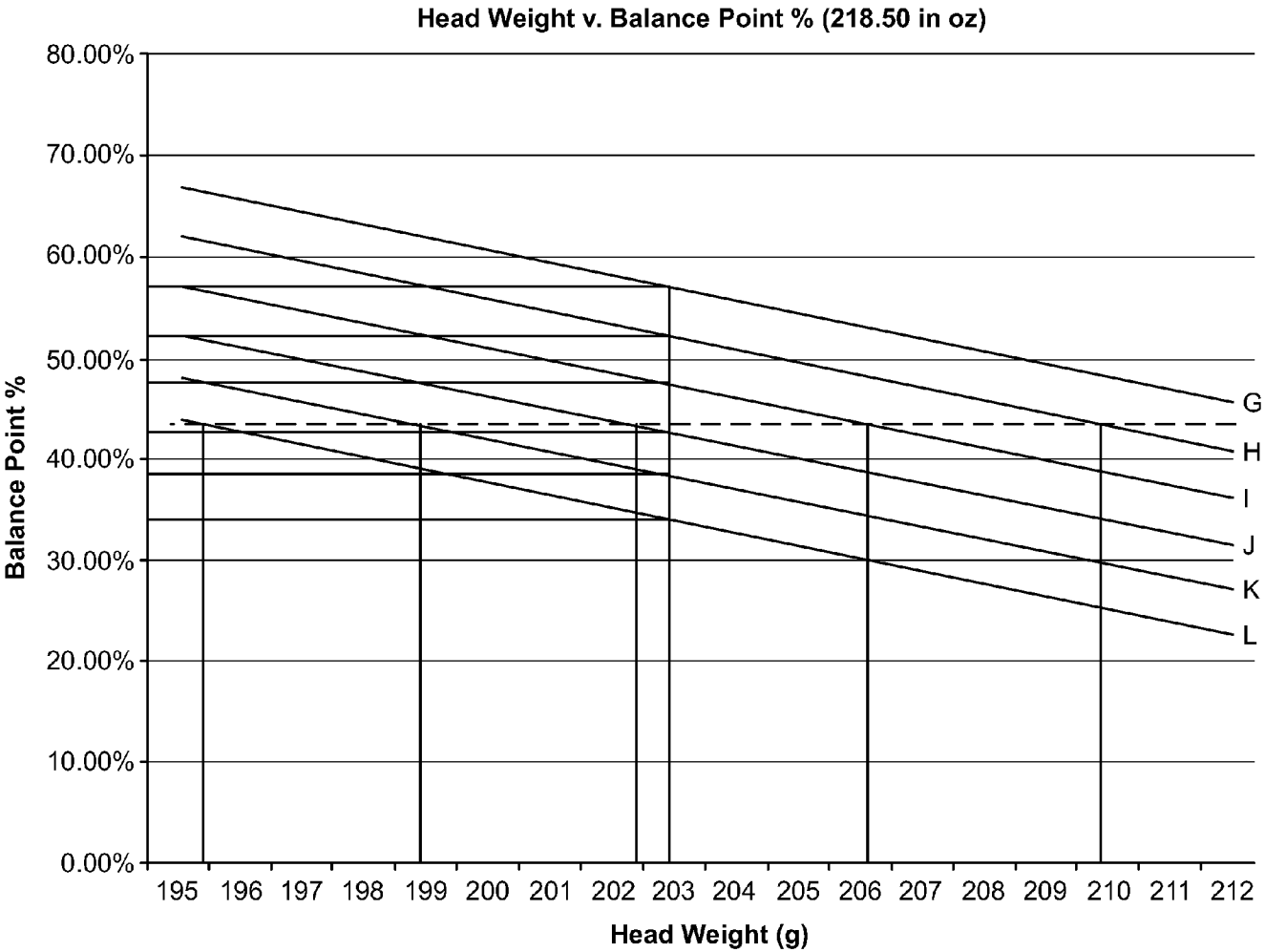
FIG. 3 is a graph illustrating the relationship between shaft balance point, club head weight and golf club length for a second swing weight.

Referring to FIG. 3, the relationship between balance point percentage and head weight is provided for golf clubs having lengths between 44.0 inches and 46.5 inches and a swing weight of 218.50 in·oz, which corresponds to a swing weight of approximately D3 on the Lorythmic scale. The illustrated relationships are based on golf clubs including shaft 14 with a weight of 57.0 grams, grip 16 having a weight of 50.0 grams and a center of gravity located approximately 4.2 inches from the butt end, and club head 12 having a blind bore configured so that the length of shaft 14 is less than the overall club length by approximately 1.25 inches.

Isobar G of FIG. 3 corresponds to golf club 10 having an overall length of 44.0 inches and illustrates that the desired swing weight is achieved with a shaft having a balance point percentage greater than 43.75% (as indicated by the dashed line) for all the head weights shown. However, as shown by Isobar H, which corresponds to golf club 10 having an overall length of 44.5 inches, a golf club of that length requires a shaft balance point percentage less than or equal to 43.75% for head weights greater than approximately 210.0 grams and keeping all else equal. Isobar I illustrates the relationship for golf club 10 having an overall length of 45.0 inches and illustrates that the swing weight is achieved after increasing the weight of club head 12 above approximately 206.0 grams by reducing the balance point percentage to less than or equal to 43.75%. A club having a length of 45.5 inches and club head weight of approximately 202.5 grams will have the desired swing weight with a shaft balance point percentage of less than or equal to 43.75%, as shown by isobar J. Isobar K corresponds to golf club 10 having an overall length of 46.0 inches and illustrates that the desired swing weight is achieved by constructing the shaft so that it has a balance point percentage less than or equal to 43.75% for club head 12 having a weight greater than approximately 199.0 grams. Isobar L illustrates the relationship for golf club 10 having an overall length of 46.5 inches and illustrates that for a club head having a weight greater than approximately 195.5 grams the swing weight is achieved by constructing shaft 14 to have a balance point percentage less than 43.75%.

FIG. 3 also illustrates that reducing the balance point percentage of the shaft allows the length of golf club 10 to be increased for a club head having a constant weight. For example, for a club head weight of 203.0 grams, a swing weight of 218.50 in·oz is achieved in a 45.0 inch golf club with a shaft balance point percentage of approximately 48.50%, but by reducing the shaft balance point percentage to approximately 43.00% the same swing weight is achieved in a golf club having a length of 45.5 inches and keeping all else equal.

Figure 4:
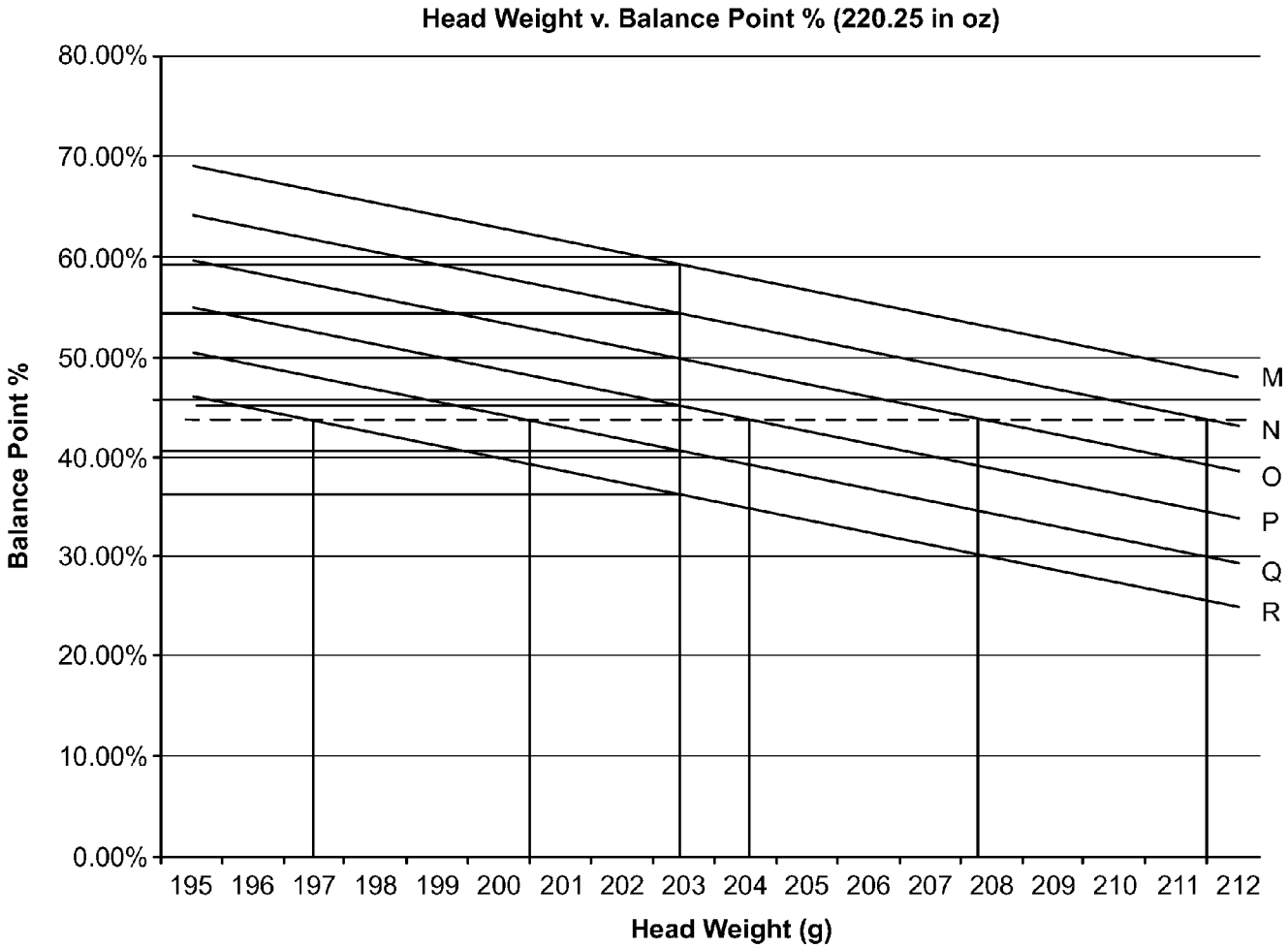
FIG. 4 is a graph illustrating the relationship between shaft balance point, club head weight and golf club length for a third swing weight.

Referring to FIG. 4, the relationship between balance point percentage and head weight is provided for golf clubs having lengths between 44.0 inches and 46.5 inches, as shown by isobars M-R, and a swing weight of 220.25 in·oz, which corresponds to a swing weight of approximately D4 on the Lorythmic scale. The illustrated relationships are based on golf clubs including shaft 14 with a weight of 57.0 grams, grip 16 having a weight of 50.0 grams and a center of gravity located approximately 4.2 inches from the butt end, and club head 12 having a blind bore configured so that the length of shaft 14 is less than the overall club length by approximately 1.25 inches.

Isobar M of FIG. 4 corresponds to golf club 10 having an overall length of 44.0 inches and illustrates that the desired swing weight is achieved with a shaft having a balance point percentage greater than 43.75% (as indicated by the dashed line) for all the head weights shown. However, as shown by Isobar N, which corresponds to golf club 10 having an overall length of 44.5 inches, a golf club of that length requires a shaft balance point percentage less than or equal to 43.75% for head weights greater than approximately 211.5 grams, keeping all else equal. Isobar O illustrates the relationship for golf club 10 having an overall length of 45.0 inches and illustrates that the swing weight is achieved after increasing the weight of club head 12 above approximately 208.0 grams by reducing the balance point percentage to less than or equal to 43.75%. A club having a length of 45.5 inches and club head weight of approximately 204.0 grams will have the desired swing weight with a shaft balance point percentage of less than or equal to 43.75%, as shown by isobar P. Isobar Q corresponds to golf club 10 having an overall length of 46.0 inches and illustrates that the desired swing weight is achieved by constructing the shaft so that it has a balance point percentage less than or equal to 43.75% for club head 12 having a weight greater than approximately 200.5 grams. Isobar R illustrates the relationship for golf club 10 having an overall length of 46.5 inches and illustrates that for a club head having a weight greater than approximately 197.0 grams the swing weight is achieved by constructing shaft 14 to have a balance point percentage less than 43.75%.

FIG. 4 also illustrates that reducing the balance point percentage of the shaft allows the length of golf club 10 to be increased for a club head having a constant weight. For example, for a club head weight of 203.0 grams, a swing weight of 220.25 in·oz is achieved in a 45.5 inch golf club with a shaft balance point percentage of approximately 44.50%, but by reducing the shaft balance point percentage to approximately 41.00% the same swing weight is achieved in a golf club having a length of 46.0 inches and keeping all else equal.

Golf club manufacturers are generally supplied shafts having raw shaft length that is greater than the length necessary for a particular club, for example driver shafts are often provided having lengths of 46.0 inches or greater. The club manufacturer then removes material from the butt end of the raw shaft to reduce the length of the shaft to the appropriate length for a desired overall length of golf club 10. The weight of shaft 14 is distributed through the shaft so that as material is removed from the shaft the balance point percentage remains less than 43.75% with the cut length of the shaft being greater than or equal to 44.0 inches.

It is also desirable to provide shaft 14 with additional attributes to control the performance attributes of the shaft in addition to providing a shaft balance point percentage of less than 43.75%. For example, the weight of shaft 14 is preferably less than 90.0 grams, more preferably 40.0-70.0 grams and even more preferably 50.0-60.0 grams. The outer diameter of tip 20 of shaft 14 is preferably 0.250-0.500 inches, and more preferably 0.330-0.355 inches. The outer diameter of butt 18 of shaft 14 is preferably 0.550-0.900 inches, and more preferably 0.560-0.700 inches. The butt frequency (i.e., frequency of vibration of shaft 14 clamped at butt 18 and tip end deflected) is preferably 200-400 cycles per minute (cpm), and more preferably 230-275 cpm. The tip frequency (i.e., the frequency of vibration of shaft 14 clamped at approximately 12.5 inches from tip 20 and the tip end deflected) is preferably 400-1200 cpm, and more preferably 550-1000 cpm. The mid frequency (i.e., the frequency of vibration of shaft 14 clamped at approximately 27.5 inches from the tip and tip end deflected) is preferably 150-450 cpm, and more preferably 250-375 cpm. Additionally, shaft 14 preferably has a torque value 1°-10°, and more preferably 2°-9°when a 1.0 ft·lb torque is applied at approximately 1.0 inch from tip 20 with butt 18 of shaft 14 clamped.

In one example, a shaft having a length of 45.8-46.2 inches and weight of 53.0-59.0 grams has a balance point of 19.15-19.85 inches from the butt end of the shaft. As a result, the shaft has a balance point percentage of 41.45%-43.34%. The shaft also includes a tip outer diameter of 0.333-0.337 inch, a butt outer diameter of 0.608-0.620 inch, a butt frequency of 240-246 cpm, a tip frequency of 680-724 cpm, a mid frequency of 304-318 cpm, and a torque of 6.25°-6.75°. In one example, a 45.0 inch golf club utilizing that shaft in a cut length, and a balance point percentage less than or equal to 44.50% after being cut, includes a club head having a weight of 200.0-208.0 grams and a grip having a weight of 43.0-48.0 grams. The resulting club has a swing weight of approximately 216.75-220.25 in oz.

In another example, a shaft having a length of 45.8-46.2 inches and weight of 57.0-63.0 grams has a balance point of 19.15-19.85 inches from the butt end of the shaft. As a result, the shaft has a balance point percentage of 41.45%-43.34%. The shaft also includes a tip outer diameter of 0.333-0.337 inch, a butt outer diameter of 0.614-0.626 inch, a butt frequency of 243-249 cpm, a tip frequency of 713-759 cpm, a mid frequency of 317-331 cpm, and a torque of 6.25°-6.75°. In one example, a 45.0 inch golf club utilizing that shaft in a cut length, and a balance point percentage less than or equal to 44.50% after being cut, includes a club head having a weight of 200.0-208.0 grams and a grip having a weight of 47.0-52.0 grams. The resulting club has a swing weight of approximately 216.75-220.25 in·oz.

In a further example, a shaft having a length of 45.8-46.2 inches and weight of 61.0-67.0 grams has a balance point of 19.35-20.05 inches from the butt end of the shaft. As a result, the shaft has a balance point percentage of 41.88%-43.78%. The shaft also includes a tip outer diameter of 0.333-0.337 inch, a butt outer diameter of 0.614-0.626 inch, a butt frequency of 258-264 cpm, a tip frequency of 774-822 cpm, a mid frequency of 338-352 cpm, and a torque of 5.35°-5.85°. In one example, a 45.0 inch golf club utilizing that shaft in a cut length, and a balance point percentage less than or equal to 44.50% after being cut, includes a club head having a weight of 200.0-208.0 grams and a grip having a weight of 50.0-55.0 grams. The resulting club has a swing weight of approximately 216.75-220.25 in·oz.

In yet another example, a shaft having a length of 45.8-46.2 inches and weight of 50.0-56.0 grams has a balance point of 19.55-20.18 inches from the butt end of the shaft. As a result, the shaft has a balance point percentage of 42.32%-44.06%. The shaft also includes a tip outer diameter of 0.333-0.337 inch, a butt outer diameter of 0.601-0.613 inch, a butt frequency of 240-246 cpm, a tip frequency of 711-755 cpm, a mid frequency of 314-328 cpm, and a torque of 6.75°-7.25°. In one example, a 45.5 inch golf club utilizing that shaft in a cut length, and a balance point percentage less than or equal to 44.50% after being cut, includes a club head having a weight of 194.0-203.0 grams and a grip having a weight of 47.5-52.5 grams. The resulting club has a swing weight of approximately 215.00-220.25 in·oz.

In another example, a shaft having a length of 45.8-46.2 inches and weight of 53.0-59.0 grams has a balance point of 19.55-20.18 inches from the butt end of the shaft. As a result, the shaft has a balance point percentage of 42.32%-44.06%. The shaft also includes a tip outer diameter of 0.333-0.337 inch, a butt outer diameter of 0.606-0.615 inch, a butt frequency of 244-250 cpm, a tip frequency of 721-766 cpm, a mid frequency of 320-334 cpm, and a torque of 5.85°-6.35°. In one example, a 45.5 inch golf club utilizing that shaft in a cut length, and a balance point percentage less than or equal to 44.50% after being cut, includes a club head having a weight of 194.0-203.0 grams and a grip having a weight of 47.5-52.5 grams. The resulting club has a swing weight of approximately 215.00-220.25 in·oz.

In another example, a shaft having a length of 45.8-46.2 inches and weight of 61.0-67.0 grams has a balance point of 19.35-20.05 inches from the butt end of the shaft. As a result, the shaft has a balance point percentage of 41.88%-43.78%. The shaft also includes a tip outer diameter of 0.333-0.337 inch, a butt outer diameter of 0.614-0.626 inch, a butt frequency of 258-264 cpm, a tip frequency of 774-822 cpm, a mid frequency of 338-352 cpm, and a torque of 5.35°-5.85°. In one example, a 45.5 inch golf club utilizing that shaft in a cut length, and a balance point percentage less than or equal to 44.50% after being cut, includes a club head having a weight of 194.0-203.0 grams and a grip having a weight of 47.5-52.5 grams. The resulting club has a swing weight of approximately 215.00-220.25 in·oz.

In another example, a shaft having a length of 45.8-46.2 inches and weight of 57.5-63.5 grams has a balance point of 19.45-20.15 inches from the butt end of the shaft. As a result, the shaft has a balance point percentage of 42.10%-44.00%. The shaft also includes a tip outer diameter of 0.333-0.337 inch, a butt outer diameter of 0.612-0.624 inch, a butt frequency of 232-238 cpm, a tip frequency of 678-720 cpm, a mid frequency of 302-316 cpm, and a torque of 7.75°-8.25°. In one example, a 45.0 inch golf club utilizing that shaft in a cut length, and a balance point percentage less than or equal to 44.50% after being cut, includes a club head having a weight of 193.0-204.0 grams and a grip having a weight of 43.0-47.5 grams. The resulting club has a swing weight of approximately 215.00-218.50 in·oz.

In yet another example, a shaft having a length of 45.8-46.2 inches and weight of 58.0-64.0 grams has a balance point of 19.45-20.15 inches from the butt end of the shaft. As a result, the shaft has a balance point percentage of 42.10%-44.00%. The shaft also includes a tip outer diameter of 0.333-0.337 inch, a butt outer diameter of 0.614-0.626 inch, a butt frequency of 246-252 cpm, a tip frequency of 712-758 cpm, a mid frequency of 320-334 cpm, and a torque of 7.75°-8.25°. In one example, a 45.0 inch golf club utilizing that shaft in a cut length, and a balance point percentage less than or equal to 44.50% after being cut, includes a club head having a weight of 194.0-205.0 grams and a grip having a weight of 47.0-52.0 grams. The resulting club has a swing weight of approximately 216.75-220.25 in oz.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

We claim:

1. A wood type golf club shaft, comprising:

an elongate body having a length greater than 44 inches and extending between a tip end and a butt end, wherein a center of gravity of the elongate body is located a distance from the butt end that is less than or equal to 43.75% of the length of the elongate body, and wherein the outer diameter of the tip end is 0.250-0.353 inch.

2. The shaft of claim 1, wherein the elongate body has a weight less than 90.0 grams.

3. The shaft of claim 2, wherein the weight of the elongate body is 40.0-70.0 grams.

4. The shaft of claim 1, wherein the outer diameter of the butt end is 0.550-0.900 inch.

5. The shaft of claim 4, wherein the outer diameter of the tip end is 0.330-0.353 inch and the outer diameter of the butt end is 0.560-0.700 inch.

6. The shaft of claim 1, wherein the elongate body has a butt frequency of 200-400 cycles per minute, a tip frequency of 400-1200 cycles per minute and a mid frequency of 150-450 cycles per minute.

7. The shaft of claim 6, wherein the elongate body has a butt frequency of 230-275 cycles per minute, a tip frequency of 550-1000 cycles per minute and a mid frequency of 250-375 cycles per minute.

8. The shaft of claim 1, wherein the elongate body has a torque value of 1°-10 °.

9. The shaft of claim 8, wherein the elongate body has a torque value of 2°-9°.

* * * * *